United States Patent [19]

Jones et al.

[11] 4,323,024

[45] Apr. 6, 1982

[54] PRESSER BAR GUIDE

[75] Inventors: Gary D. Jones, Short Hills; Manfred R. Laidig, Whippany; William Weisz, Tenafly, all of N.J.

[73] Assignee: The Singer Company, Stamford, Conn.

[21] Appl. No.: 141,879

[22] Filed: Apr. 21, 1980

[51] Int. Cl.[3] ..... D05B 29/02

[52] U.S. Cl. ..... 112/237

[58] Field of Search ..... 112/235–237, 112/238, 121, 78; 403/229

[56] References Cited

U.S. PATENT DOCUMENTS 3,507,069 4/1970 Borba, Sr. ..... 403/229
3,933,106 1/1976 Murray ..... 112/235

FOREIGN PATENT DOCUMENTS 652246 3/1979 U.S.S.R. ..... 112/237

*Primary Examiner*—Werner H. Schroeder
*Assistant Examiner*—Andrew M. Falik
*Attorney, Agent, or Firm*—James M. Trygg; Robert E. Smith; Edward L. Bell

[57] ABSTRACT

A hollow bushing (22 or 54) that guides a presser bar (21) to move in a longitudinal direction is threaded at one end (29 and 30). The outer surface of that end is round and, below the thread (59), fits closely but rotatably in a channel (32) in the head (16) of a sewing machine. The bushing is not fixedly held in place in the channel (32). Instead, a tension spring (33) screwed onto the threaded end and onto a threaded member (37) attached to the end of the presser bar (21) within the head (16) pulls the presser bar downwardly so that its foot (24) normally presses against the work (46) and simultaneously pulls the bushing (22 or 54) toward the head (16). A shoulder surface (27 or 58) at a certain location on the bushing (22 or 54) acts as a stop to limit the extent that the cylinder can be drawn into the head. The spring (33) is fully screwed onto the threaded sleeves (30 and 36) until the ends of the spring butt against surfaces (34 and 40), eliminating operator-adjusted presser foot pressure and simiplying the presser foot pressure mechanism.

4 Claims, 3 Drawing Figures

PRESSER BAR GUIDE

DESCRIPTION

BACKGROUND OF THE INVENTION

This invention relates to the field of presser bars for sewing machines and, in particular, to a simplified presser bar guide structure that substantially eliminates the necessity of presser foot pressure adjustment by the sewing machine operator. The invention is especially related to a presser bar bushing that need not be rigidly attached to the head of the machine and is, therefore, easy to install. The presser bar bushing of this invention is also simple to manufacture.

Various arrangements have been proposed heretofore to use tension springs to furnish the force necessary for a sewing machine presser bar. One such arrangement is shown in the copending application of James A. Transue and William Weisz, Ser. No. 81,404, filed Oct. 3, 1979 and assigned to the assignee of the present case. In that application, a tension spring is screwed onto threaded, hollow sleeves extending from members spaced along the presser bar. The force of the spring is directed along the axis of the presser bar to avoid pulling the presser bar to one side, which would produce an effect known as stick slip. The member nearer the presser foot end of the presser bar is held down by an adjustment structure that includes a yoke that prevents the member from rotating. The yoke is attached to adjustment means to adjust the pressure applied from the tension spring via the presser bar and the presser foot to work being sewn. The member onto which the other end of the tension spring is screwed is rigidly attached to the opposite end of the presser bar from the presser foot and is connected to a presser foot lever pivotally mounted on a rigid part of the machine and having a cam through which pressure is applied to lift the pressure bar and the presser foot away from the material being sewn to allow that material to be moved freely.

The apparatus to which the tension spring is connected in the Transue et al application is relatively complex to manufacture, assemble and operate. The basic concept of applying pressure axially by way of a tension spring screwed onto a threaded sleeve attached to the presser bar and another threaded sleeve attached to the machine to avoid stick slip operates quite satisfactorily, but its specific embodiment in the Transue et al application involves complex machining and assembly operations. In addition, it makes available to the sewing machine operator a presser bar pressure adjustment that we have since determined to be unnecessary and even undesirable.

The use of an extension spring to apply downward force to a presser bar to bias it against the work in a sewing machine has been suggested by Rodman in U.S. Pat. No. 823,442, by Feigel in U.S. Pat. No. 1,749,529, by Niekrawietz in U.S. Pat. No. 3,282,237, by Herr in U.S. Pat. No. 3,611,963, by Giesselmann et al in U.S. Pat. No. 4,044,701, and by Takikawa in Japanese disclosed patent application 53-141755, published Dec. 9, 1978. However, in each of those documents, the force of the extension spring was not applied directly along the axis of the presser bar but was applied to one side of the axis. This not only produced a mechanical moment resulting in mechanical hysteresis, but also made it impossible to achieve the simplified arrangement of screwing the spring onto threaded members concentric with the presser bar. A further spring adjustment mechanism was proposed by Chawick in U.S. Pat. No. 1,221,138 in which a spring was screwed onto the threaded end of a bolt rotatably supported in a sewing machine head. The other end of the spring was attached to a feeding bar to apply pressure to it, entirely separate from the presser foot.

OBJECTS AND SUMMARY OF THE INVENTION

It is a main object of this invention to reduce the cost of sewing machine manufacture without reducing reliability of operation.

A related object is to provide a simplified presser bar support mechanism with a substantially reduced number of parts, each easy to manufacture and to assemble with the other parts, in particular by avoiding the necessity of attaching the presser bar guide bushing rigidly to the head of the machine.

Another object is to simplify operation of a sewing machine by permitting only limited adjustment of presser foot pressure to be made, normally only during manufacture of the machine, if at all.

Further objects will become apparent from the following specification, together with the drawings.

In accordance with the present invention, a cylindrical presser bar is guided for longitudinal movement in a hollow, cylindrical bushing having an external surface that is smooth and round along at least part of its cylindrical length. The cylindrical support member includes internal journal means near its opposite ends to guide the longitudinal movement of the presser bar. A smooth cylindrical part is held in a relatively close-fitting round channel in the head of a sewing machine and is prevented from being forced too far into the head by a shoulder that bears against the outer surface of the head surrounding the channel. At the end of the cylindrical part inside the head is a threaded tubular portion of suitable configuration onto which one end of a helical tension spring is screwed.

The tension spring pulls the shoulder against the head, which keeps the bushing from falling out but avoids the necessity of using a set screw or any other means to hold the bushing rigidly in place. This reduces the cost of the parts associated with applying pressure to the presser bar by 30 percent or even more. The spring coaxially surrounds the part of the presser bar within the head of the machine and is screwed onto a hollow, tubular, externally threaded portion of another member rigidly attached to the presser bar at or near the end of the presser bar within the sewing machine head. This latter member has a surface against which a presser bar lever cam surface can be forced to raise the presser bar against tensile force provided by the spring. The latter threaded member also has a shoulder at the end of its threaded portion, and one end of the spring is screwed against this shoulder to set the location of that end of the spring. The other end of the spring is screwed against the inner surface of the head immediately adjacent the threaded tubular portion of the presser bar bushing.

Rigid attachment of the bushing to the head of the machine is not only unnecessary but undesirable. The characteristics of the spring are calculated so that, normally, it is screwed against the shoulder on the member at one end and against the inner surface of the head at the other end. Screwing the spring against fixed stops at each end eliminates the necessity of accurately gaging the position of the spring during manufacture of the machine. If necessary, the tension can be adjusted, but only as a factory adjustment during assembly of the machine. At that time, limited adjustment can be made by rotating the end of the bushing that extends through the channel in the head to reduce the tension.

DETAILED DESCRIPTION OF THE PREFERRED EMBODIMENT

Figures 1, 2, 3:
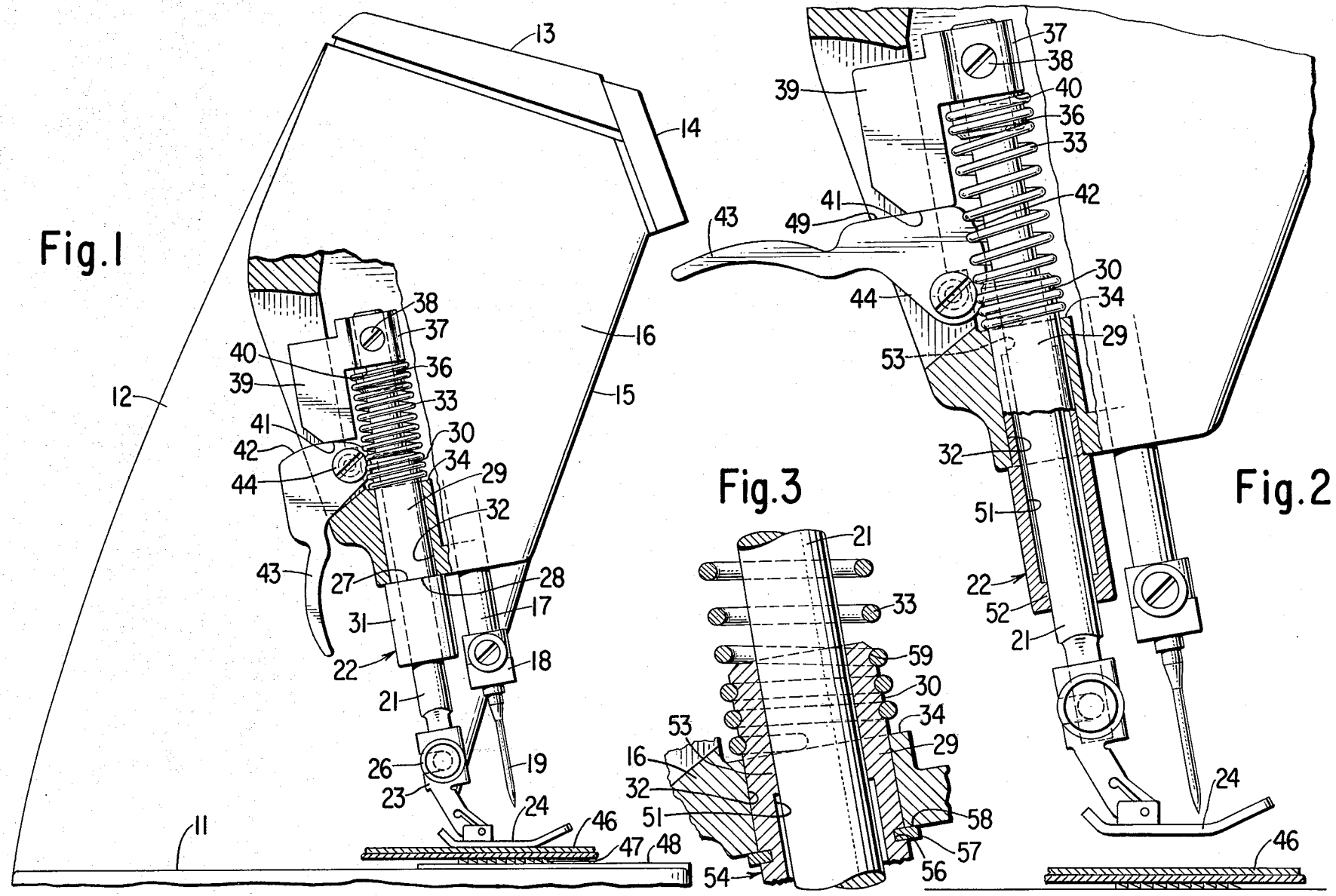
FIG. 1 is an end view of a sewing machine incorporating the presser bar arrangement of the present invention and with parts of the structure broken away to show some of the internal components.
FIG. 2 is an enlarged cross-sectional view of a fragment of the presser bar arrangement in FIG. 1 to illustrate the attachment of one end of the tension spring.
FIG. 3 is an enlarged cross-sectional view of a fragment of a modified embodiment of the head of the sewing machine in FIG. 1.

The machine in FIG. 1 includes a bed 11 with a standard 12 extending upwardly therefrom. At the upper end of the standard is an arm, the surfaces 13–15 of which appear only as edges in FIG. 1. At the end of the arm, and in front of the upper end of the standard 12, as depicted in FIG. 1, is a head 16 of the sewing machine. A needle bar 17 is mounted in the head 16 in the customary way and has a clamp 18 at its lower end to hold a needle 19.

This invention is particularly concerned with apparatus associated with a presser bar 21. Such apparatus includes a hollow cylinder, or bushing, 22 in which the cylindrical presser bar 21 is journalled for longitudinal movement. The lower end of the presser bar 21 is conventionally shaped so that a holder 23 of a presser foot 24 may be attached to it by means of a knurled screw 26. The bushing 22 has a shoulder 27 that abuts against the lower surface 28 of the head 16 when the bushing is properly in place. Above the shoulder 27 is a portion 29 of the cylinder 22 that has a smaller diameter than the portion 31 below the shoulder. The portion 29 is smoothly rounded and fits snugly into a round hole, or channel, 32 in the lower part of the head 16.

The tubular end of the portion 29 constitutes a hollow sleeve 30 that extends into the hollow space within the head 16 and is threaded to receive one end of a tension spring 33. The spring 33 is screwed onto the threaded end 30 until it engages an abutment surface portion 34 of the inner surface of the head 16 immediately adjacent the channel 32. The other end of the spring 33 is screwed onto another hollow, threaded sleeve 36 that can be identical to the sleeve 30 at the end of the portion 29 and is integral with an attachment member 37 rigidly attached to the upper end of the needle bar 21 by means of a set screw 38. In this embodiment, the member 37 has a downwardly facing abutment surface 40 against which the spring 33 is screwed, and a downwardly extending section 39 with a lowermost surface 41 located where it can be engaged by a cam surface 42 of a presser bar lifting lever 43. The lever 43 is pivotally mounted on a shoulder screw 44 in the head 16.

The sewing machine in FIG. 1 is shown with the presser foot 24 down against material 46 that is to be sewn. This material is engaged from below by a feed dog 47 that extends up through a throat plate 48 in the bed 11.

FIG. 2 shows the presser bar 21 and the presser foot 24 in their respective elevated positions to free the material 46 so that it can be moved easily. In order to raise the presser bar 21, the lever 43 is shown pivoted clockwise from the position it occupies in FIG. 1. The cam surface 42 has pushed the member 39 upwardly, and a flat surface 49 has come into position to receive the surface 41 of the member 39 substantially directly in line with the screw 44 so that the lever 43 is stable in this position and can hold the presser bar 21 and presser foot 24 elevated without the necessity of the operator's having to hold the lever 43 up.

Part of the bushing 22 is shown broken away in FIG. 2 to illustrate that, over most of its length, its inner surface 51 has a larger diameter than the external cylindrical surface of the presser bar 21. The bushing 22 is formed with short regions 52 and 53 of inner diameter just enough larger than the outer diameter of the presser bar 21 to allow a smooth sliding fit between the presser bar and these regions of reduced diameter, which serve as journals for the presser bar.

The spring 33 is shown extended in FIG. 2, as is required to provide the force that urges the presser bar 21 downwardly in opposition to the restraint provided by the presser bar lever 43.

In order to assemble the presser bar mechanism, the upper end of the spring 33 may be screwed onto the sleeve 36 until it comes into contact with the surface 40. Next, the member 37 is fitted onto the upper end of the presser bar 21, which extends loosely through the channel 32, and is attached to the presser bar by tightening the set screw 38. Thereafter, the bushing 22 is aligned with the channel 32 and the lower end of the presser bar 21 and is fed upwardly to engage the lower end of the spring 33. Then the bushing 22 is rotated to screw the threaded sleeve 30 into the spring 33 until the lowermost end of the spring abuts against the surface 34. Under normal circumstances, this is all that is necessary to assemble these parts, but if, in testing the machine following complete assembly, it appears that a modification in the presser foot pressure should be made, the bushing 22 may be backed off slightly from the position in which the ends of the spring 33 are in contact with the surfaces 34 and 40. The characteristics of the spring are so calculated that the only such adjustment likely to be required is one that would necessitate this backing off; the bushing 22 cannot be turned in the direction to cause the spring 33 to be more fully screwed onto the sleeve 30 or the sleeve 36 because such further engagement of the spring is prevented by contact with the surfaces 34 and 40.

FIG. 3 is an enlarged cross-sectional view of a small part of a modified presser bar support structure. The modified structure includes a bushing 54 that has a uniform diameter over most of its length, instead of having an upper portion of one diameter and a lower portion of a large diameter with a shoulder at the intersection of the two portions. In FIG. 3, the bushing 54 has a groove 56 into which a split ring 57 is fitted, and the upper surface 58 of the split ring is the equivalent of the shoulder 27 in FIG. 1. Above the level of the shoulder surface 58, the bushing 54 is virtually identical with the upper portion 29 in the embodiment of FIGS. 1 and 2 and the component parts of this upper portion are identified by the same reference numerals as are used in the embodiment in FIGS. 1 and 2.

The enlarged cross-sectional view in FIG. 3 permits the configuration of the thread 59 on the sleeve 30 to be shown. The thread has a semi-circular cross-section that substantially matches the shape of the wire of which the spring 33 is made. This is also the same thread configuration formed on the sleeve 36 in the embodiment of FIGS. 1 and 2. The root diameter of the thread 59 is such that there is a small interference between the spring 33 and the surface that defines the thread 59. This interference does not pose a problem when the sleeve 30 is being screwed into the spring, because any engagement between the spring and the thread 59 tends to unwind the spring, i.e., to enlarge its inner diameter, which makes it easier to screw the threaded sleeve into the spring. However, it is much more difficult to unscrew the sleeve, because any friction between the surface of the thread 59 and the surface of the spring 33 tends to wind the spring more tightly, i.e., to reduce its inner diameter, which causes the spring to grip the sleeve more firmly.

FIG. 3 shows more clearly than does FIGS. 1 or 2 the extent of which the spring 33 is screwed onto the sleeve 30. As may be seen in FIG. 3, the spring 33 is screwed far enough onto the sleeve 30 to cause the tip end of the spring to come into contact with the surface 34. This grips the portion of the head 16 immediately between the end of the spring 33 and the shoulder surface 58, which stabilizes the position of the bushing 54 in the channel 32. While the channel 32 fits snuggly around the portion 29, the two components are not bound together as they would be by an interference fit. There is still a minute amount of looseness that could show up as a minute pivoting about some undefined axis perpendicular to the coincident axes of the presser bar 21, the bushing 54, and the channel 32. By tightening the sleeve 30 into the spring 33, the end of the spring and the shoulder surface 58 are forced against opposite surfaces of the head 16, thereby stabilizing to an even greater degree the physical relationship between the portion 29 and the head 16.

We claim:

1. In a sewing machine that comprises a loop-taker, a head spaced from the looptaker and having a round channel facing generally towards the looptaker, and a presser bar that extends longitudinally through the channel, presser bar support and guide means comprising:

a hollow presser bar guide bushing comprising a first portion adjacent a first end of the bushing, the first portion having a circularly cylindrical outer surface that extends through and substantially fills the channel, and a second portion between the first portion and the opposite end of the bushing;

a shoulder surface on said bushing extending outwardly beyond said channel at the end of the first portion proximal to the second portion;

guide means in the bushing to guide the presser bar for longitudinal movement relative to the bushing;

a first threaded sleeve at the end of the first portion of the bushing within the head and substantially coaxial with the axis of the first portion;

a helical tension spring, one end of which is screwed onto the first threaded sleeve to be held thereby with the axis of the helical spring substantially coincident with the axis of the first portion of the cylindrical outer surface of the bushing; and attachment means attached to one end of the presser bar within the head and comprising a second threaded sleeve, the other end of the tension spring being screwed onto the second threaded sleeve to be held thereby with the axis of the second threaded sleeve coincident with the axis of the first threaded sleeve, wherein the tension spring pulls the shoulder surface of the bushing against the head.

2. The presser bar support and guide means of claim 1 in which the second portion of the hollow presser bar guide bushing has a larger cross-section than the first portion, and the change of cross-sectional area between the first and second portions forms the shoulder surface.

3. The presser bar support and guide means of claim 1 in which the first portion of the guide bushing is rotatable within the channel.

4. The presser bar support and guide means of claim 1 in which the guide bushing comprises a circumferential groove intermediate the ends thereof, and the guide means further comprises:

a split ring tightly held within the groove, the first portion of the guide bushing comprising that part of the guide bushing between the ring and the first end of the bushing, the outwardly extending shoulder surface comprising the outwardly extending part of the surface of the ring facing the first portion of the bushing.

* * * * *